US007637392B2

(12) United States Patent
Hsu et al.

(10) Patent No.: US 7,637,392 B2
(45) Date of Patent: Dec. 29, 2009

(54) ELECTRIC CAULKING GUN

(75) Inventors: Chih-Hua Hsu, Taichung (TW); Chen-Chen Cheng, Taichung (TW); Rui-Heng Lin, Taichung (TW)

(73) Assignee: Techway Industrial Co., Ltd., Taichung (TW)

( * ) Notice: Subject to any disclaimer, the term of this patent is extended or adjusted under 35 U.S.C. 154(b) by 316 days.

(21) Appl. No.: 11/889,078

(22) Filed: Aug. 9, 2007

(65) Prior Publication Data

US 2009/0039113 A1 Feb. 12, 2009

(51) Int. Cl.
*B67D 5/52* (2006.01)

(52) U.S. Cl. ..... 222/137; 222/327; 222/333; 222/390; 222/571

(58) Field of Classification Search ..... 222/137, 222/326, 327, 333, 386, 390, 571
See application file for complete search history.

(56) References Cited

U.S. PATENT DOCUMENTS 4,583,934 A * 4/1986 Hata et al. ..... 425/376.1
4,615,469 A * 10/1986 Kishi et al. ..... 222/327
4,669,636 A * 6/1987 Miyata ..... 222/153.01
5,775,539 A * 7/1998 Bates et al. ..... 222/1
5,909,830 A * 6/1999 Bates et al. ..... 222/327
6,123,235 A * 9/2000 Hsu ..... 222/327
6,540,113 B2 * 4/2003 Gardos ..... 222/137
6,889,872 B2 * 5/2005 Herman et al. ..... 222/82

* cited by examiner

*Primary Examiner*—Kevin P Shaver
*Assistant Examiner*—Daniel R Shearer
(74) *Attorney, Agent, or Firm*—Posz Law Group, PLC

(57) ABSTRACT

An electric caulking gun has a body, a gearbox, a caulking barrel, a pushing device, a driving assembly, an actuating assembly, a motor and a power source. The body has a mounting section and a handle section. The gearbox is mounted in the body and has a seat and a mounting sheath. The caulking barrel is connected to the gearbox. The pushing device is connected movably to the gearbox and has a rack, a linking sheet, two pushing shafts and a pushing disc. The driving assembly is mounted in the gearbox. The actuating assembly is mounted between the gearbox and the body. The motor is mounted in the body between the mounting section and the mounting sheath of the gearbox. The power source is connected detachable to the handle section of the body.

10 Claims, 12 Drawing Sheets

ELECTRIC CAULKING GUN

BACKGROUND OF THE INVENTION

1. Field of the Invention

The present invention relates to a caulking gun, and more particularly relates to an electric caulking gun that can be used conveniently.

2. Description of Related Art

Conventional caulking gun includes a manual and an automatic type, and usually comprises a caulking barrel, a handle, a pushing bracket and a signal direction drive ring. The caulking barrel is used to hold with a caulking tube. The handle is formed with the caulking barrel and has a pressing arm. The pushing bracket is connected movably to the caulking barrel over the handle. The signal direction drive ring is mounted around the pushing bracket to push the pushing bracket moving relative to the caulking tube by the pressing arm of the handle.

However, when the conventional caulking gun is used with the caulking tube, the drive ring can only move in a single direction to make the pushing bracket moving forward and this may make the gel flow out of the caulking tube if the person does not use the conventional caulking gun. This may make the working place dirty and waste the gel of the caulking tube and inconvenient in use.

To overcome the shortcomings, the present invention provides an electric caulking gun to mitigate or obviate the aforementioned problems.

SUMMARY OF THE INVENTION

The main objective of the present invention is to provide an electric caulking gun that can be used conveniently.

The electric caulking gun has a body, a gearbox, a caulking barrel, a pushing device, a driving assembly, a switch, a motor and a power source. The body has a chamber and a handle section. The gearbox is mounted in the body and has a seat and a mounting sheath. The caulking barrel is connected to the gearbox. The pushing device is connected movably to the gearbox and has a rack, a linking sheet, two pushing shafts and a pushing disc. The driving assembly is mounted in the gearbox. The switch is mounted between the gearbox and the body. The motor is mounted in the handle between the chamber and the mounting sheath of the gearbox. The power source is connected detachable to the handle section of the body.

DETAILED DESCRIPTION OF THE PREFERRED EMBODIMENT

Figure 1:
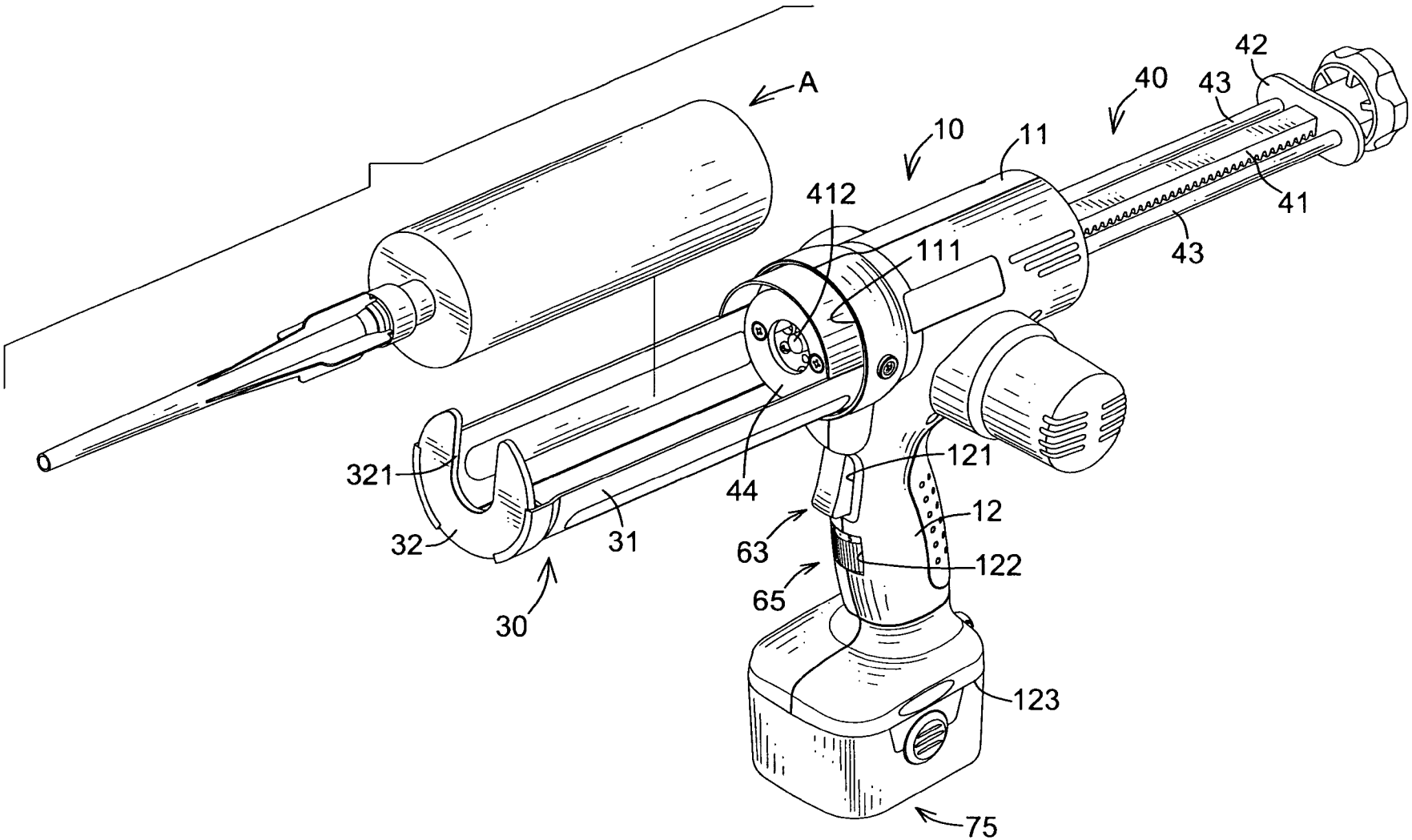
FIG. 1 is a perspective view of an electric caulking gun in accordance with the present invention with a caulking tube.
Figure 2:
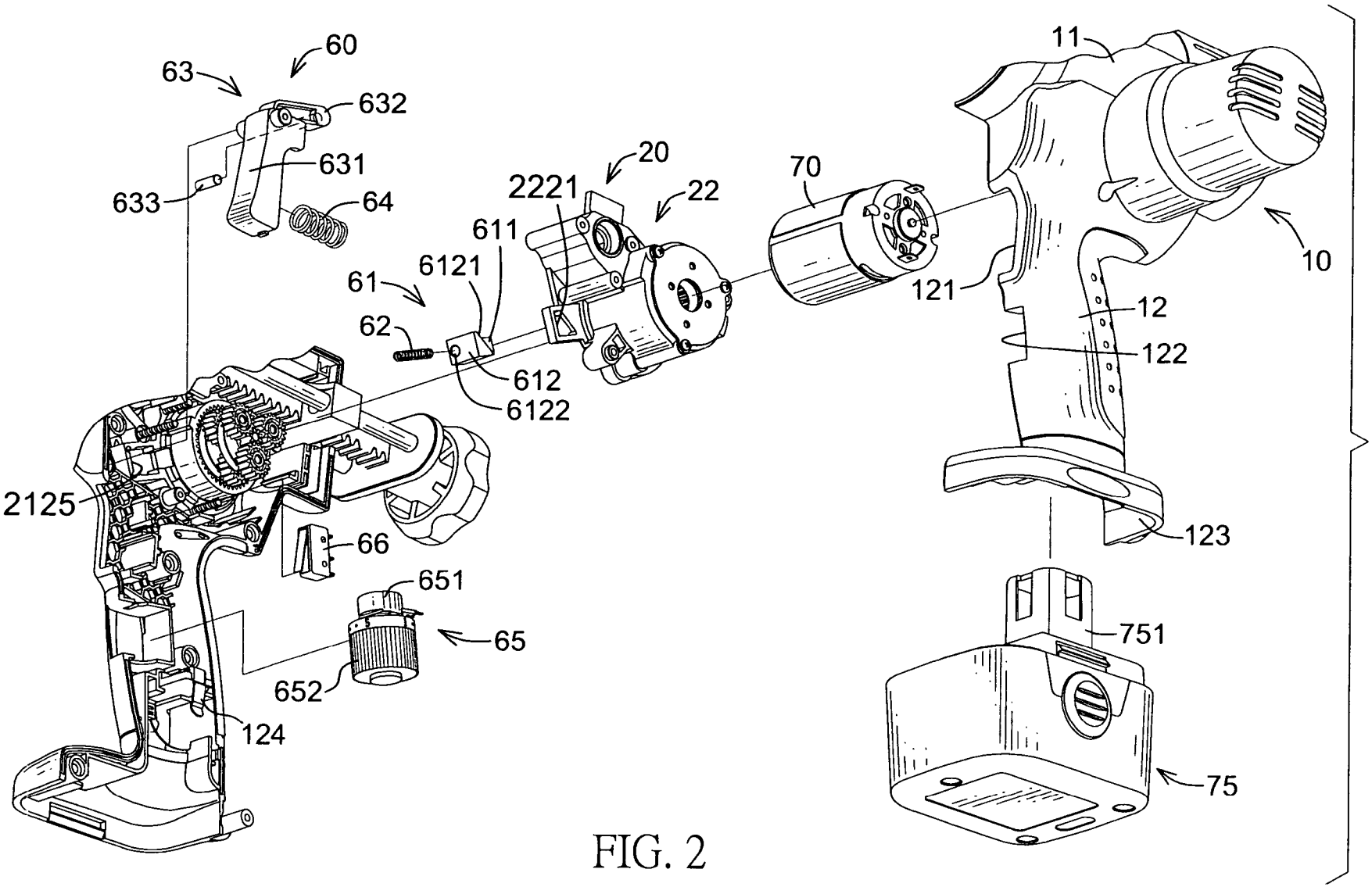
FIG. 2 is a partial exploded perspective view of the electric caulking gun 6 in FIG. 1.
Figure 3:
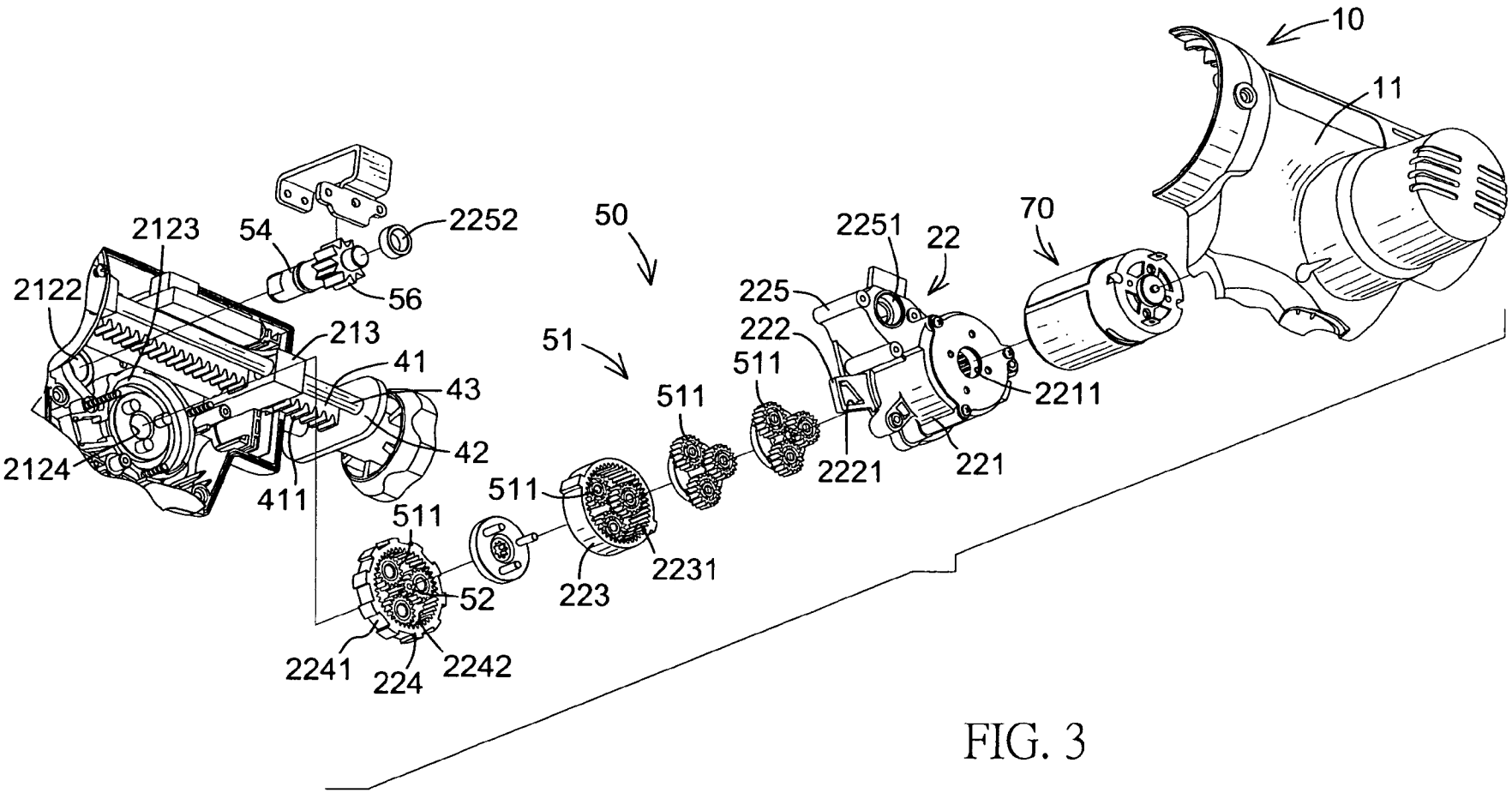
FIG. 3 is another partial exploded perspective view of the electric caulking gun in FIG. 1.

With reference to FIGS. 1 to 3, an electric caulking gun in accordance with the present invention comprises a body (10), a gearbox (20), a caulking barrel (30), a pushing device (40), a driving assembly (50), an actuating assembly (60), a motor (70) and a power source (75).

With reference to FIGS. 1 to 4, The body (10) is hollow, is implemented with two half-casings and has a mounting section (1) and a handle section (12).

The mounting section (11) has a front end, a rear end, an interior, a front opening (111) and a rear opening (112). The openings (111, 112) are respectively formed in the front end and the rear end of the mounting section (11) and communicate with the interior.

The handle section (12) extends transversely from the mounting section (11) and has a top end, an lower end, a chamber, an outer surface, a connecting hole (121), an optional mounting hole (122), an optional inserting hole (123) and an optional circuit contact (124). The top end of the handle section (12) is formed on the mounting section (11) near the front end of the mounting section (11). The chamber is formed in the handle section (12) between the top end and the lower end and communicates with the interior of the mounting section (11). The connecting hole (121) is formed through the outer surface of the handle section (12). The mounting hole (122) is formed through the outer surface of the handle section (12) below the connecting hole (121). The inserting hole (123) is defined on the lower end of the handle section (12) and communicates with the chamber. The circuit contact (124) is attached to the handle section (12) near the inserting hole (123).

Figure 5:
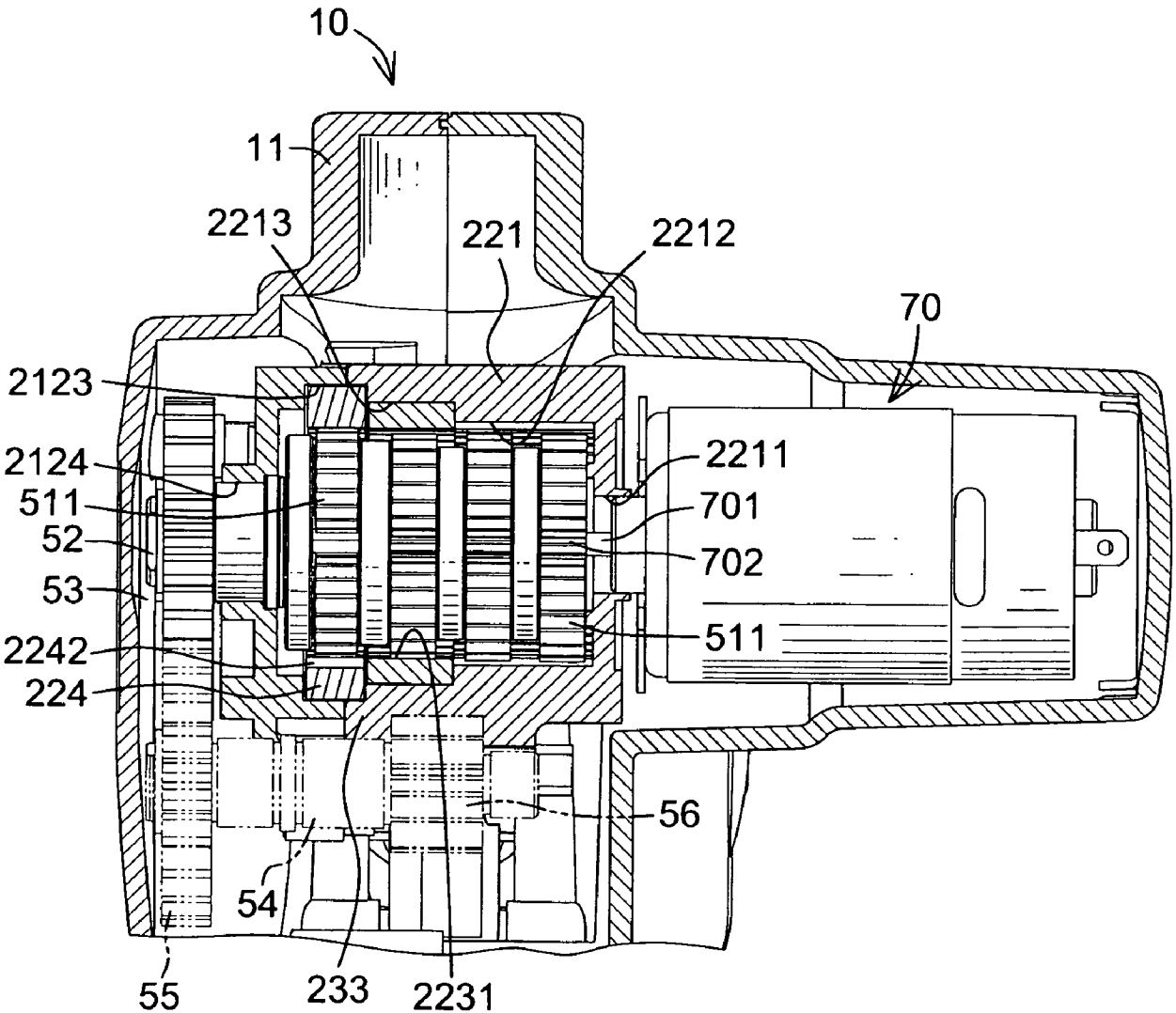
FIG. 5 is a partial side view of the electric caulking gun in FIG. 1.
Figure 6:
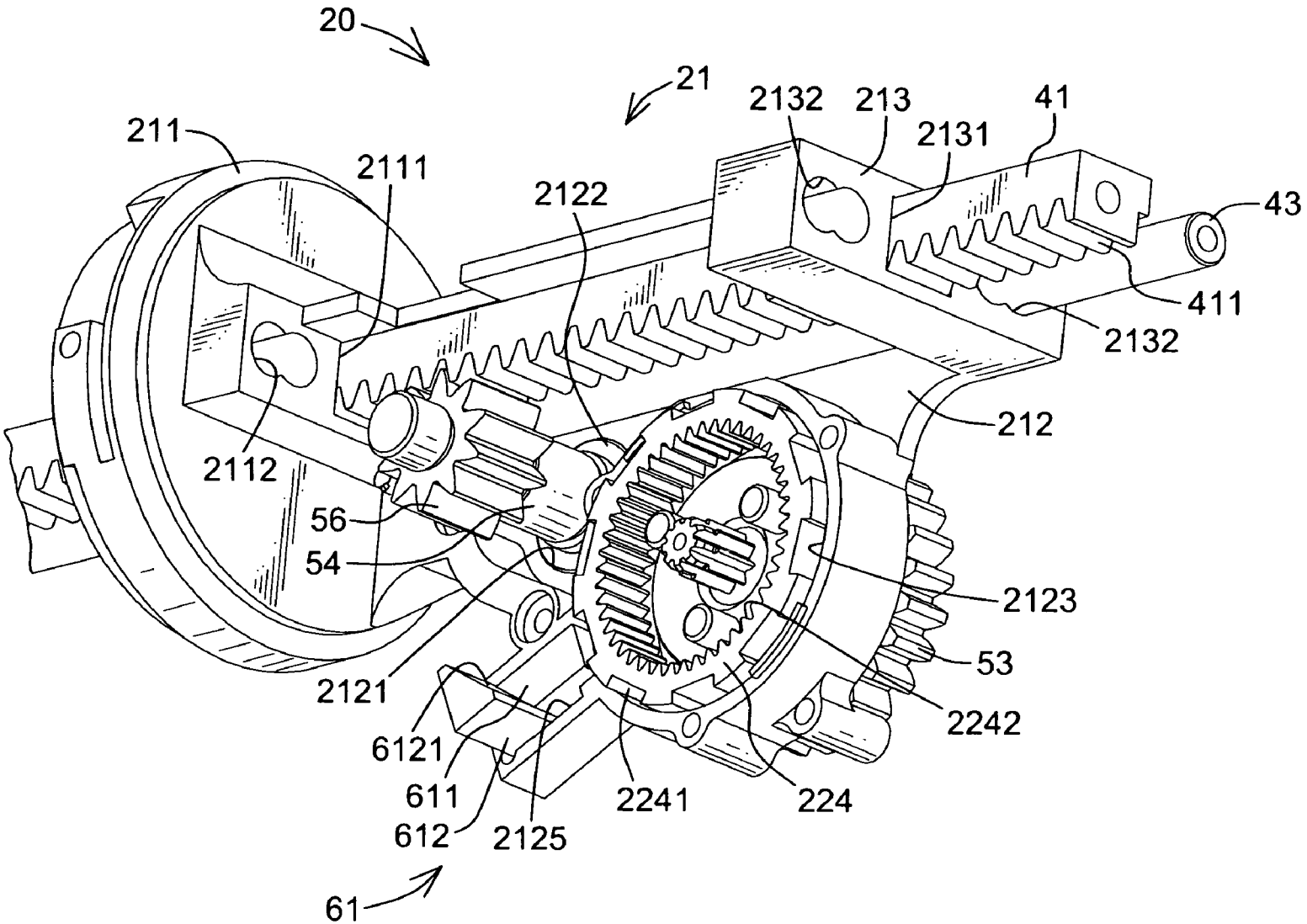
FIG. 6 is another rear partial perspective view of the electric caulking gun in FIG. 1.
Figure 7:
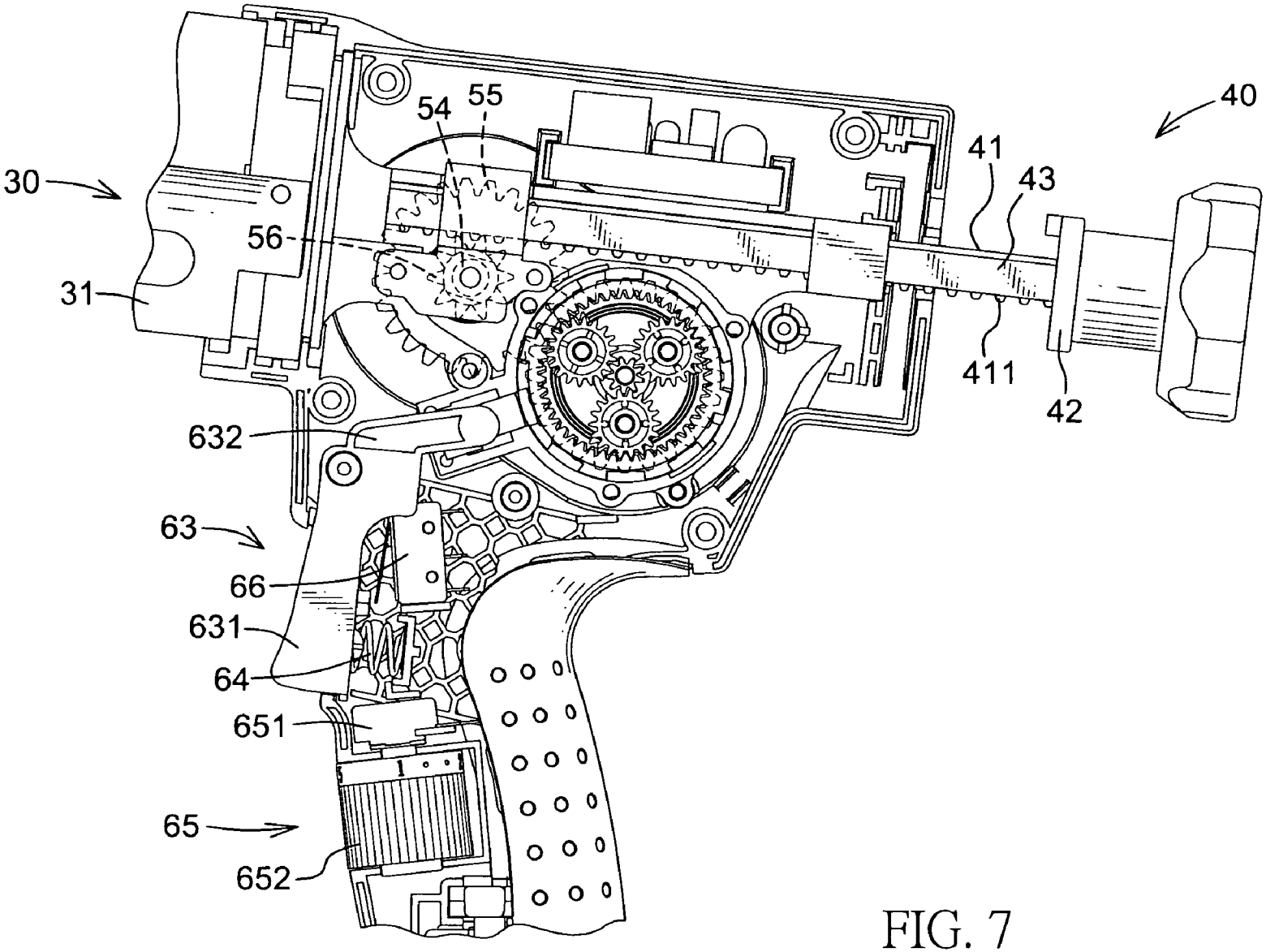
FIG. 7 is another partial side view of the electric caulking gun in FIG. 1.
Figure 8:
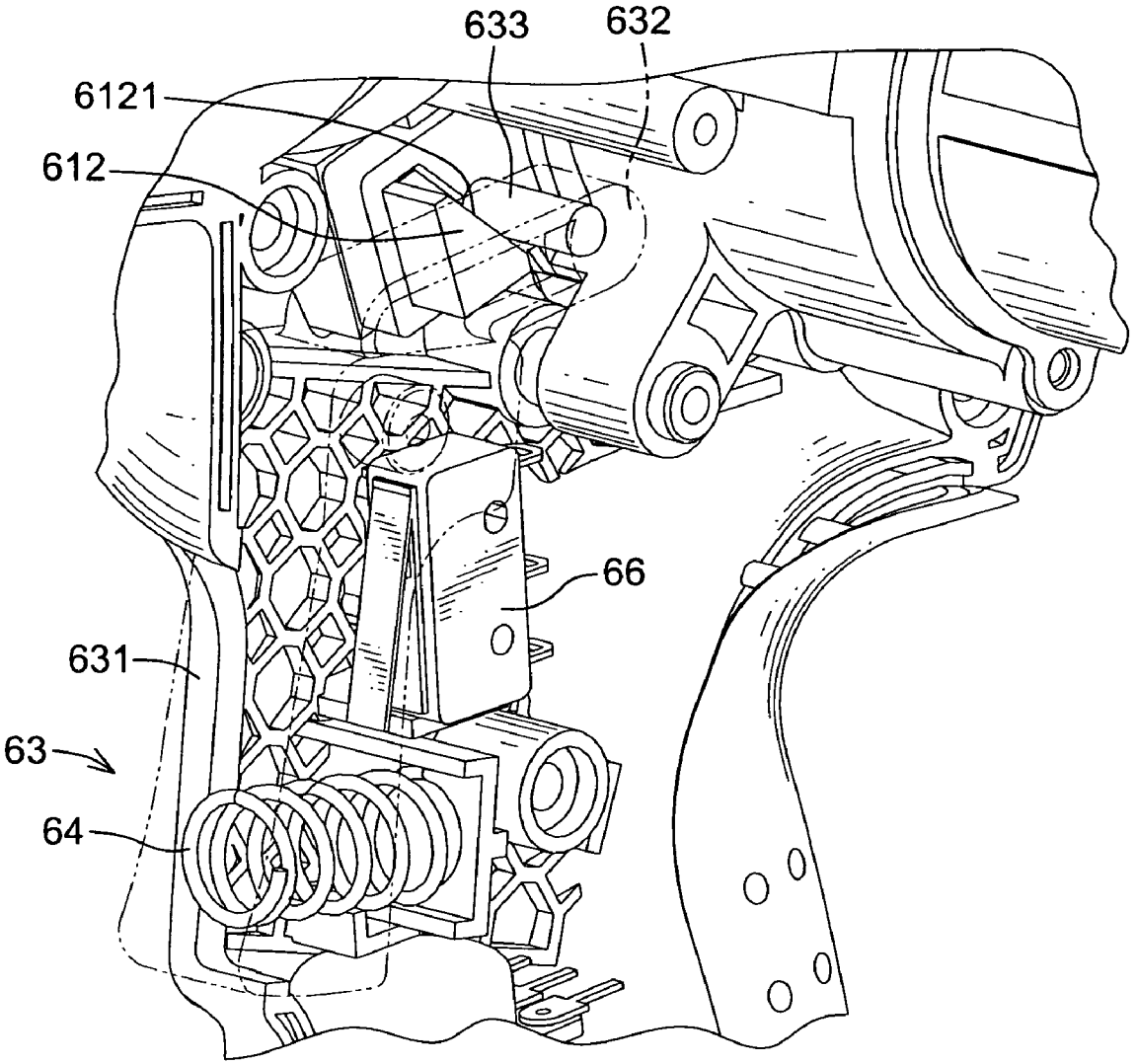
FIG. 8 is a partial perspective view of a handle section of the electric caulking gun in FIG. 1.
Figure 9B:
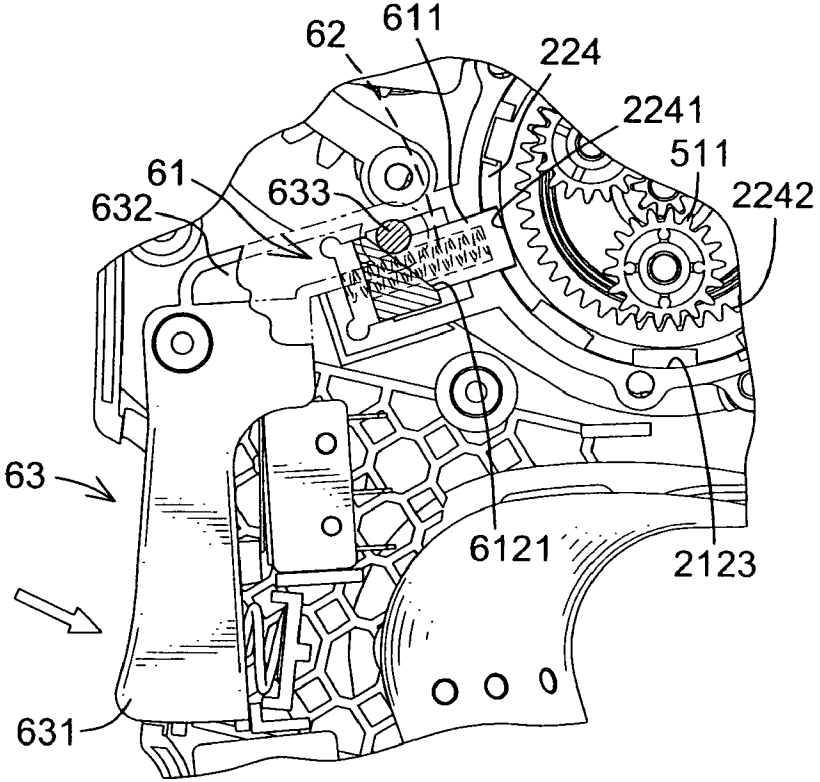
FIGS. 9A and 9B are operational partial side views of the electric caulking gun in FIG. 1.
Figure 9A:
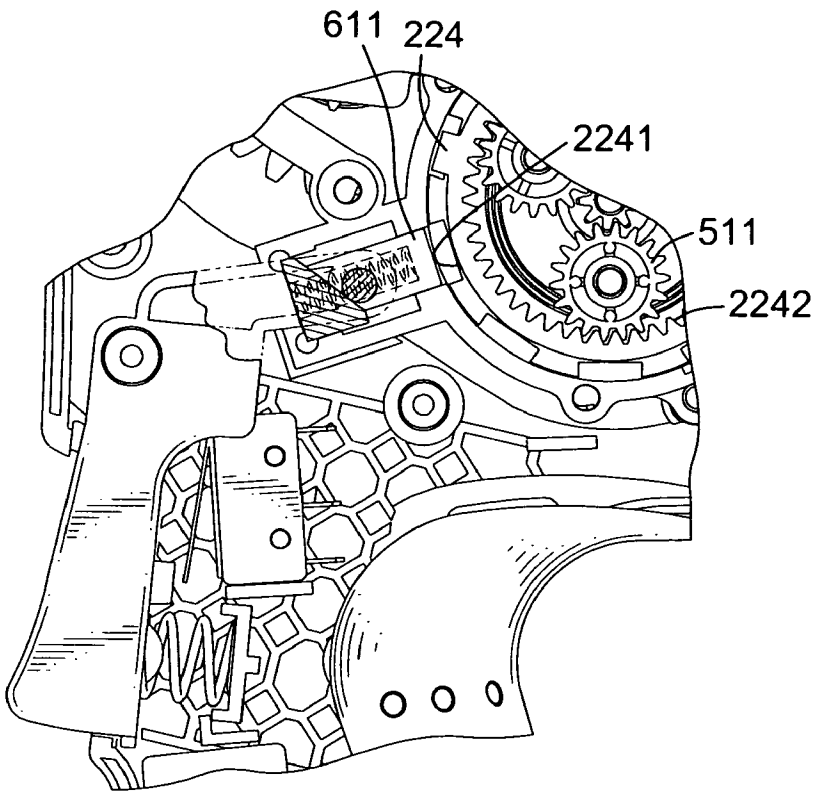

With further reference to FIGS. 5 and 6, The gearbox (20) is mounted in the body (10) and has a seat (21) and a mounting sheath (22).

The seat (21) is mounted in the interior of the mounting section (11) and has a front end, a rear end, a connecting panel (211), a side panel (212) and a fixed block (213).

The connecting panel (211) is formed on the front end of the seat (21), is connected securely to the mounting section (11) in the front opening (111) and has a center, a rear side, a rack hole (2111) and two pushing shaft hole (2112). The rack hole (2111) is formed through the center of the connecting panel (211) and has two sides. The pushing shaft holes (2112) are formed through the connecting panel (211) and are respectively near the sides of the rack hole (2111).

The side panel (212) is formed on the rear side of the connecting panel (211) and has a front end, a rear end, an inner surface, an outer surface, a first axle hole (2121), an optional axle bearing (2122), a mounting recess (2123), a second axle hole (2124) and a pushing element recess (2125). The first axle hole (2121) is formed through the side panel (212) near the front end below the rack hole (2111). The axle bearing (2122) is mounted in the first axle hole (2121). The mounting recess (2123) is formed in the inner surface of the side panel (212) near the rear end and has a center. The second axle hole (2124) is formed through the center of the mounting recess (2123). The pushing element recess (2125) is formed in the inner surface of the side panel (212) between the axle bearing (2122) and the mounting recess (2123) and communicates with the mounting recess (2123).

The fixed block (213) is formed on the rear end of the side panel (212) and aligns with the rear opening (112) of the mounting section (11) and has a rack hole (2131) and two pushing shaft holes (2132). The rack hole (2131) is formed through the fixed block (213), aligns with the rack hole (2111) of the connecting panel (211) and has two sides. The pushing shaft holes (2132) are formed through the fixed block (213), are respectively near the sides of the rack hole (2131) and respectively align with the pushing shaft holes (2112) of the connecting panel (211).

The mounting sheath (22) is connected to the seat (21) in the mounting section (11) and has a jacket (221), a covering section (222), an optional gear container (225), an optional gear ring (223) and a rotating ring (224).

The jacket (221) is connected to the side panel (212) and has an open end, a closed end, an external surface, an internal surface, an optional through hole (2211), multiple engaging teeth (2212) and an optional engaging recess (2213). The open end of the jacket (221) is mounted securely around the mounting recess (2123) in the side panel (212). The through hole (2211) is formed through the closed end of the jacket (221). The engaging teeth (2212) are formed around the internal surface of the jacket (221) near the closed end. The engaging recess (2123) is formed in the internal surface of the jacket (221) near the open end.

The covering section (222) is formed on the external surface of the jacket (221), is faced to the pushing element recess (2125) and has an outer surface and an elongated hole (2221). The elongated hole (2221) is formed through the outer surface of the covering section (222) and aligns with the pushing element recess (2125).

The gear container (225) is formed on external surface of the jacket (221) adjacent to the covering section (222), is mounted around the first axle hole (2121) in the side panel (212) and has a axle hole (2251) and a axle bearing (2252). The axle hole (2251) is formed through the gear container (225) and aligns with the first axle hole (2121) in the side panel (212). The axle bearing (2252) is mounted in the axle hole (2251) of the gear container (225).

The gear ring (223) is mounted in the engaging recess (2213) of the jacket (221) and has an internal surface and multiple engaging teeth (2231). The engaging teeth (2231) are formed around the internal surface of the gear ring (223) and align with the engaging teeth (2212) of the jacket (221).

The rotating ring (224) is mounted rotatably in the mounting recess (2123) of the side panel (212) and has an external surface, an internal surface, multiple mounting slots (2241) and multiple engaging teeth (2242). The mounting slots (2241) are formed equi-spaced in the external surface of the rotating ring (224) and correspond to the pushing element recess (2125) in the side panel (212). The engaging teeth (2242) are formed around the internal surface of the rotating ring (224) and align with the engaging teeth (2212, 2231) of the jacket (221) and the gear ring (223).

Figure 4:
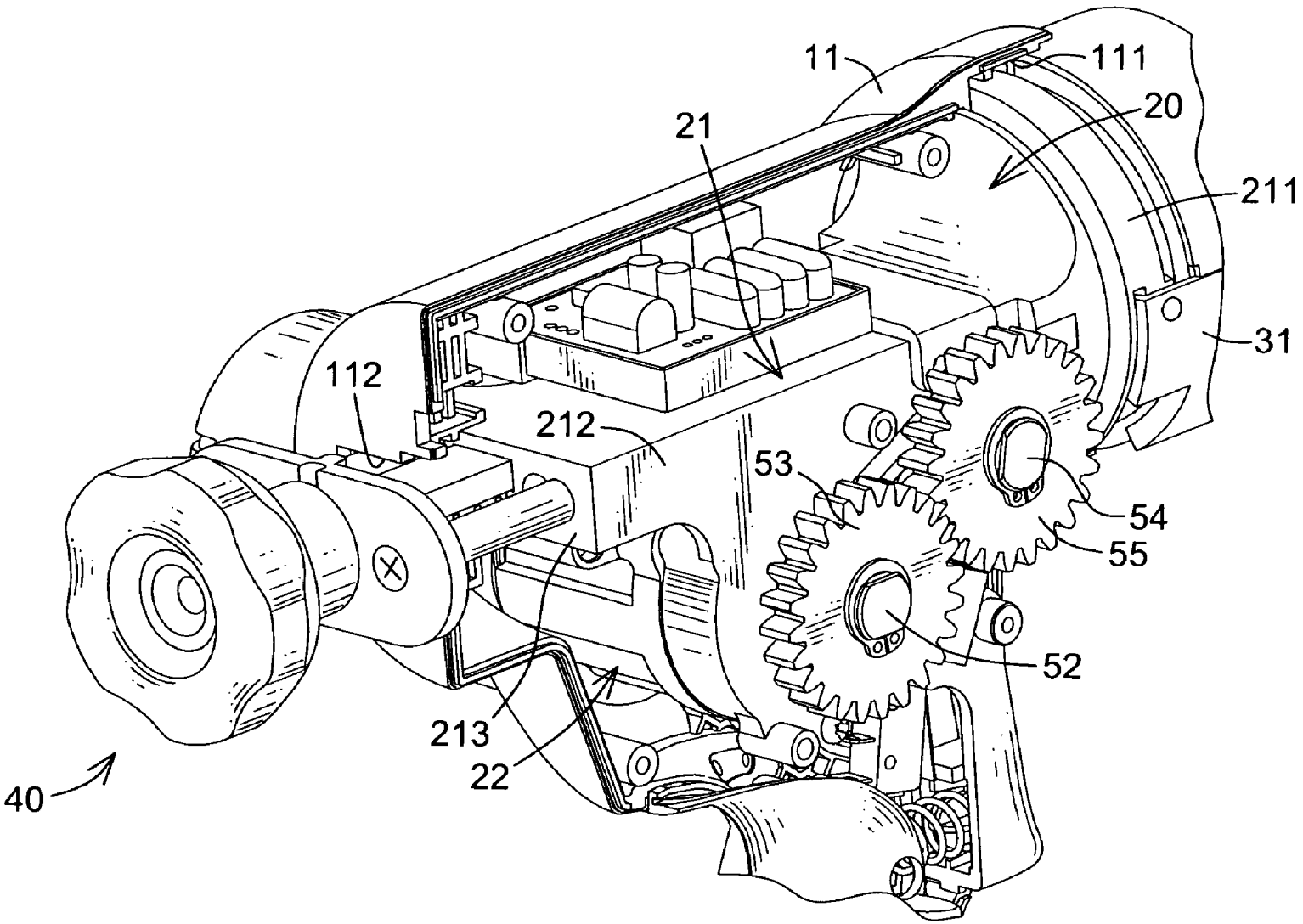
FIG. 4 is a rear partial perspective view of the electric caulking gun in FIG. 1.

With reference to FIGS. 1 and 4, the caulking barrel (30) is connected to the gearbox (20) and has an optional mounting casing (31) and an optional limiting panel (32). The mounting casing (31) is semicircular, is connected to the connecting panel (211) in the front opening (111) of the mounting section (11) and has a front end, a rear end and a mounting recess. The rear end of the mounting casing (31) is mounted around the connecting panel (211) of the seat (21). The mounting recess of the caulking barrel (30) is formed between the front end and the rear end of the mounting casing (31). The limiting panel (32) is attached to the front end of the mounting casing (31) and has a U-shaped through hole (321) that communicates with the mounting recess of the mounting casing (31).

With reference to FIGS. 1 and 6, the pushing device (40) is connected movably to the gearbox (20) and has a rack (41), two pushing shafts (43), a linking sheet (42) and a pushing disc (44).

The rack (41) is connected movably to the seat (21), extends through the rack holes (2111, 2131) and has a front end, a rear end, a bottom face, multiple pushing teeth (411) and a pushing post (412). The front end extends to the front opening (111) of the mounting section (11). The rear end of the rack (41) extends out the rear opening (112) of the mounting section (11). The pushing teeth (411) are formed on the bottom face of the rack (41). The pushing post (412) is formed on the front end of the rack (41).

The pushing shafts (43) are respectively connected movably to the seat (21), are extended through the pushing holes (2112, 2132) and each pushing shaft (43) has a front end and a rear end. The front ends of the pushing shafts (43) extend out the front opening (111). The rear ends of the pushing shafts (43) extend out the rear opening (112). The linking sheet (42) is mounted securely on the rear ends of the rack (41) and the pushing shafts (43). The pushing disc (44) is connected to the front ends of the pushing shafts (43) and aligns with the limiting panel (32) of the caulking barrel (30).

With reference to FIGS. 3 to 7, the driving assembly (50) is mounted in the gearbox (20) and has a planet gear mechanism (51), a driving axle (52), a driving gear wheel (53), a driven axle (54), a driven gear wheel (55) and an actuating gear wheel (56).

The planet gear mechanism (51) is mounted in the mounting sheath (22) and has four planet gear assemblies (511). Three of the planet gear assemblies (511) are mounted in the jacket (221) and the gear ring (223) and engage with the engaging teeth (2212, 2231). The other one of the planet gear assemblies (511) is mounted in the rotating ring (224) and engages with the engaging teeth (2242).

The driving axle (52) is mounted rotatably in the second axle hole (2124) and extends in the rotating ring (224) between the planet gear assembly (511) and has an inner end and an outer end. The inner end of the driving axle (52) extends in the rotating ring (224). The outer end of the driving axle (52) extends out the outer surface of the side panel (212) through the second axle hole (2124).

The driving gear wheel (53) is mounted around the outer end of the driving axle (52). The driven axle (54) is mounted in the side panel (212) and the gear container (225) between the axle bearings (2122, 2252) and has an inner end and an outer end. The inner end extends in the axle hole (2251) of the gear container (225). The outer end extends out the side panel (212) through the first axle hole (2121).

The driven gear wheel (55) is mounted around the outer end of the driven axle (54) and engages with the driving gear wheel (53). The actuating gear wheel (56) is mounted around the driven axle (54) near the inner end and engages with the pushing teeth (411) of the rack (41).

With reference to FIGS. 1, 2, 6 to 9A, the actuating assembly (60) is connected to the gearbox (20) and the body (10) and has a pushing element (61), a first spring (62), a switch (63), a second spring (64), an optional transmission (65) and an optional fine-tuning switch (66).

The pushing element (61) is mounted between the pushing element recess (2125) and the elongated hole (2221) and has an inserting block (611) and a pushing section (612). The inserting block (611) is mounted movably in the pushing element recess (2125) and has a front side. The pushing section (612) is formed on the front side of the inserting block (611), extends in the elongated hole (2221) of the covering section (222) and has an inner face, an outer face, an inclined plane (6121) and a mounting hole (6122). The inclined plane (6121) is defined on the inner face of the pushing section (612). The mounting hole (6122) is formed in the outer face of the pushing section (612).

The first spring (62) is mounted in the mounting hole (6122) of the pushing element (61) and abuts against a sidewall of the pushing element recess (2125).

The switch (63) is connected to the handle section (12) of the body (10) and abuts against the pushing element (61) and has a pressing arm (631), a connecting arm (632) and a connecting pin (633). The pressing arm (631) is connected pivotally to the handle section (12) and has an upper end, a lower end and a rear side. The upper end of the pressing arm (631) is connected pivotally to the handle section (12). The lower end of the pressing arm (631) extends out the handle section (12) through the connecting hole (121). The connecting arm (632) is formed on the rear side of the pressing arm (631) near the upper end and extends to the pushing element (61). The connecting pin (633) is mounted securely to the connecting arm (632) opposite to the pressing arm (631) and abuts against the incline plane (6121) of the pushing element (61).

The second spring (64) is mounted between the handle section (12) and the rear side of the pressing arm (631).

The transmission (65) is connected electrically to the circuit contact (124) in the mounting hole (122) of the handle section (12) and has a top, a bottom, an adjustable resistance (651) and a rotating button (652). The adjustable resistance (651) is formed on the top of the transmission (65). The rotating button (652) is formed on the bottom of the transmission (65) and protrudes out the handle section (12) through the mounting hole (122).

The fine-tuning switch (66) is mounted in the handle section (12) between the connecting arm (632) and the second spring (64) and is connected electrically to the adjustable resistance (651) of the transmission (65).

With reference to FIGS. 2, 3 and 5, the motor (70) is mounted in the body (10) between the mounting section (1) and the mounting sheath (22) of the gearbox (20), is electrically connected to the fine-tuning switch (66) and has an inner side, a rotating shaft (701) and a gear wheel (702). The rotating shaft (701) is connected rotatably to inner side of the motor (70) and extends in the jacket (221) through the through hole (2211). The gear wheel (702) is mounted around the rotating shaft (701) and engages with one of the planet gear assemblies (511).

With reference to FIGS. 1 and 2, the power source (75) is connected detachable to the inserting hole (123) of the handle section (12) and has a top and a joint (751). The joint (751) is formed on the top of the power source (75) and is connected electrically to the circuit contact (124).

With reference to FIGS. 1 and 2, a caulking tube (A) is mounted in the mounting casing (31) of the caulking barrel (30) between the limiting panel (32) and the pushing disc (44), then the pushing post (412) on the front end of the rack (41) is aimed at a rear end of the caulking tube (A). When a person holds the handle section (12) and presses the switch (63), the fine-tuning switch (66) will make the motor (70) operates. The motor (70) is supplied power by the power source (75) and can be changed the rotating speed by the rotating button (652) of the transmission (65).

With further reference to FIGS. 3, 7, 8 and 9B, when pressing the switch (63), the connecting pin (633) will depart from the incline plane (6121) and the first spring (62) will push the inserting block (611) of the pushing element (61) into the mounting recess (2123) and engage with one of the mounting slots (2241). Then, the rotating ring (224) is fixed in the mounting recess (2123) and can not rotate relative to the side panel (212).

With reference to FIGS. 3 to 6, as the motor (70) is operated, the actuating gear wheel (56) is rotated by the rotating shaft (701) via the gear wheel (702), the planet gear mechanism (51), the driving axle (52), the driving gear wheel (53), the driven gear wheel (55) and the driven axle (54). With the rotation of the actuating gear wheel (56), the rack (41) and the pushing shafts (43) are moved forward. When the pushing shafts (43) moving with the rack (41), the pushing disc (44) and the pushing post (412) will push the rear end of the caulking tube (A) to inject the caulk.

A person can stop to inject the gel from the caulking tube (A) by releasing the switch (63). The second spring (64) will push the switch (63) return to the original location and the connecting pin (633) will abut against the inclined plane (6121) to let the inserting block (611) departing from the corresponding mounting slot (2241) of the rotating ring (224). Then, the rotating ring (224) can rotated in the mounting recess (2123) of the side panel (212) and the rack (41) and the pushing shafts (43) can be moved backward by the idle running of the rotating ring (224). This can prevent the gel from flowing out the caulking tube (A) when not using the electric caulking gun.

Figure 10:
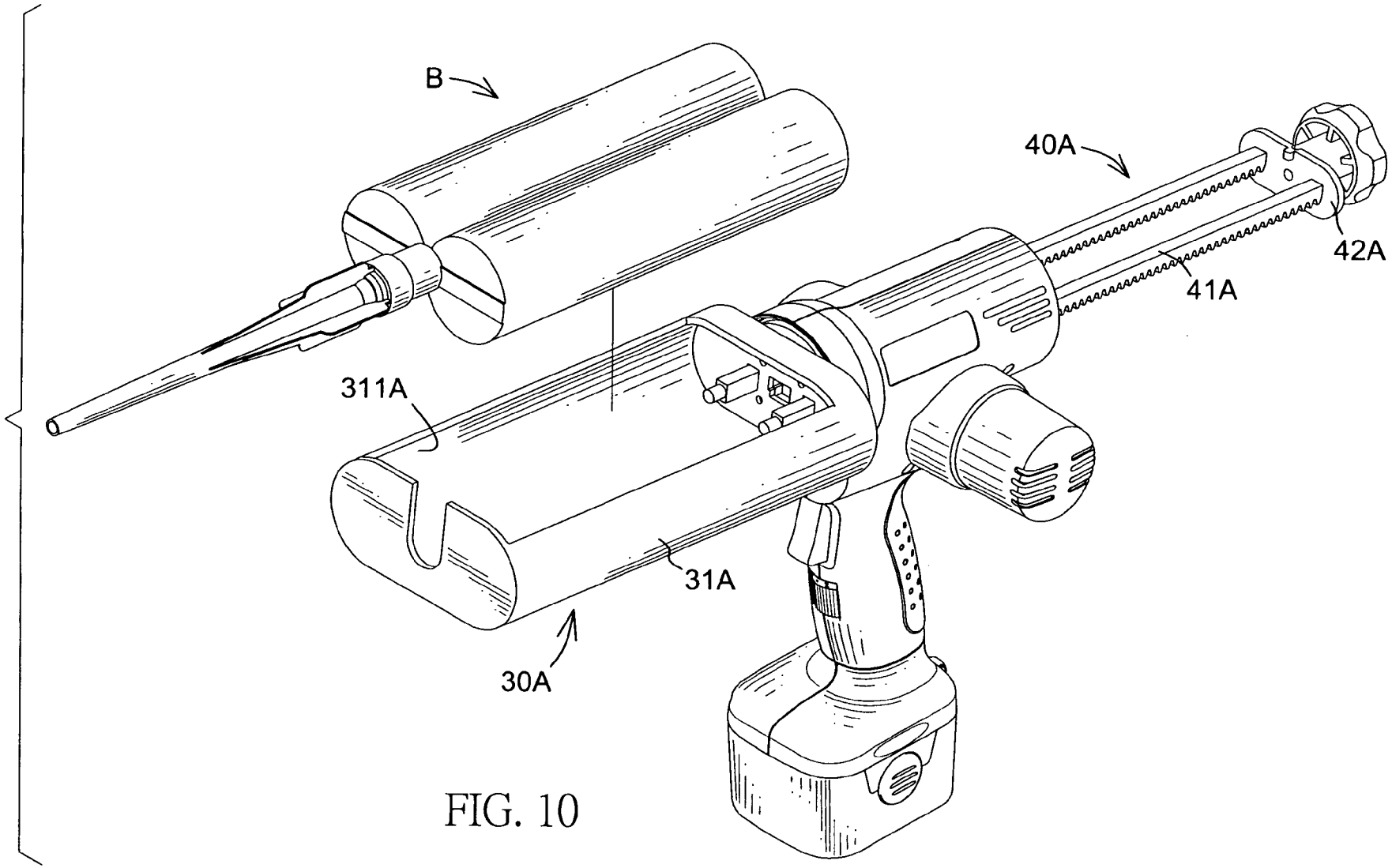
FIG. 10 is a perspective view of another embodiment of an electric caulking gun in accordance with the present invention with a caulking tube.
Figure 11:
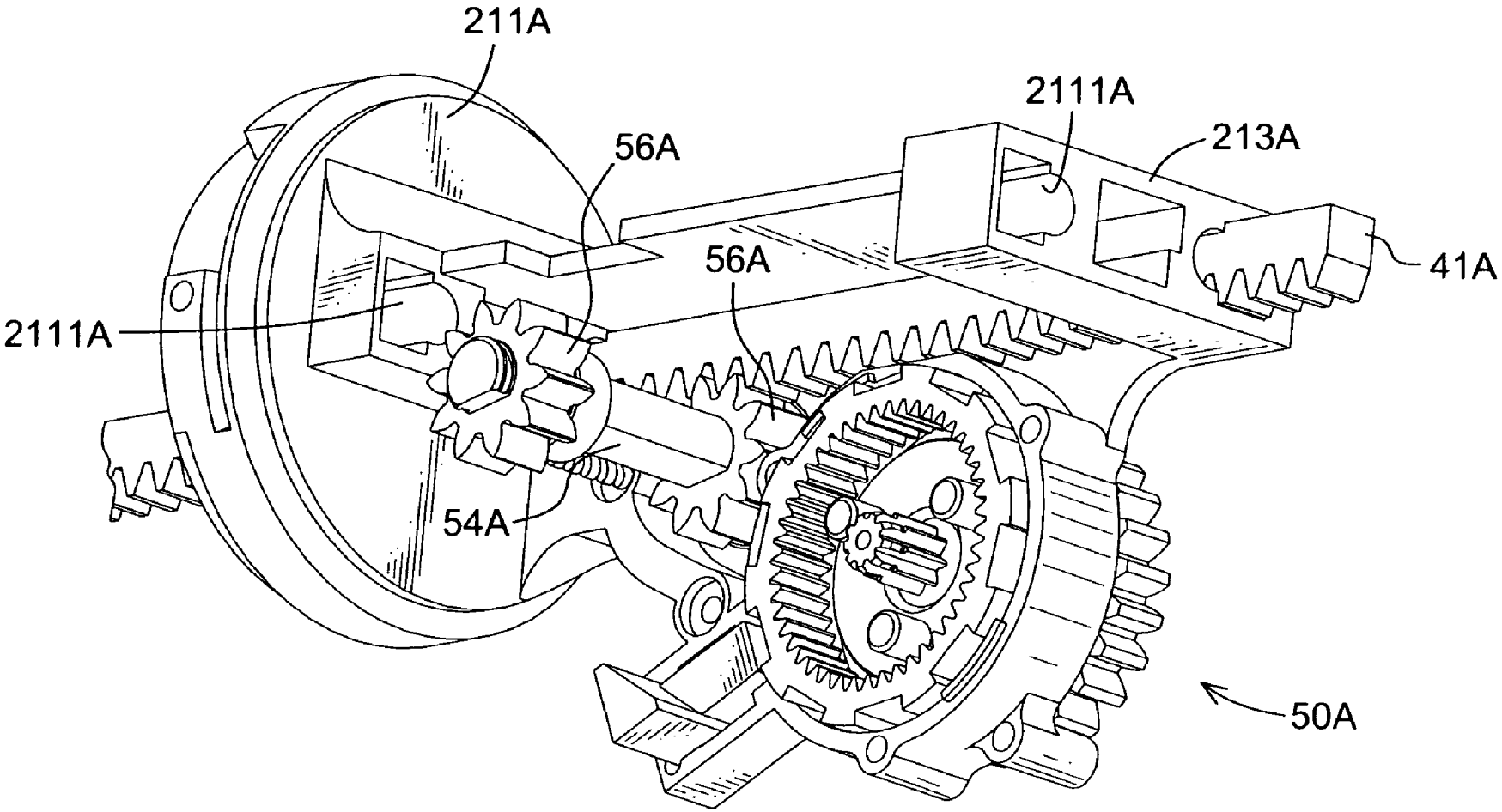
FIG. 11 is a rear partial perspective view of the electric caulking gun in FIG. 10.
Figure 12:
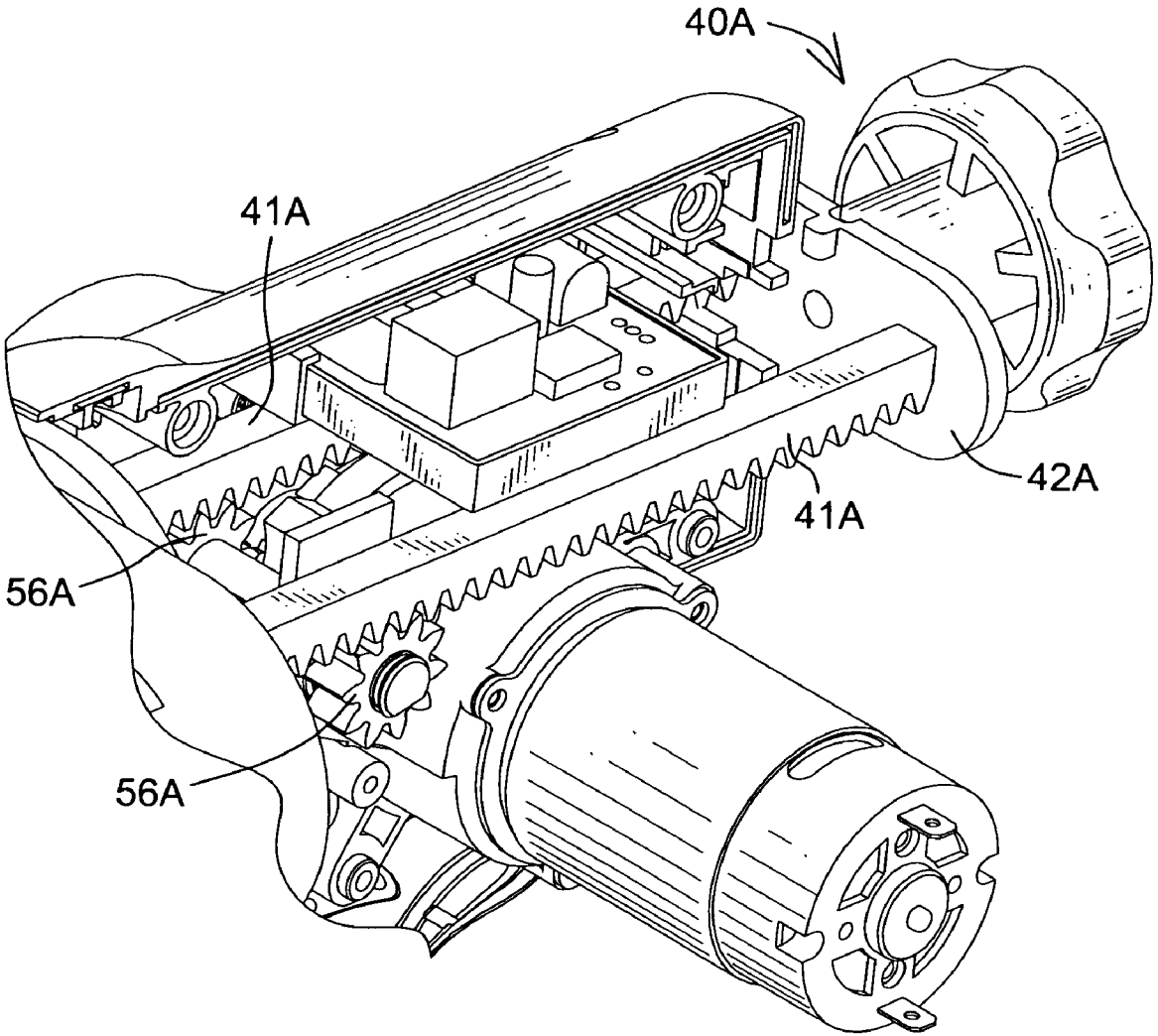
FIG. 12 is a partial perspective view of the electric caulking gun in FIG. 10.

With reference to FIGS. 10 to 12, another embodiment of an electric caulking gun in accordance with the present invention has a similar structure as the aforementioned embodiment except that:

The connecting panel (211A) and the fixed block (213A) each has two rack holes (2111A). The pushing device (40A) has two racks (41A) that extended through the rack holes (2111A) of the connecting panel (211A) and the fixed block (213A). The linking sheet (42A) are mounted securely on the rear ends of the racks (41A). The driving assembly (50A) has two actuating gear wheels (56A) corresponding to the racks (41A) of the pushing device (40A). The mounting recess (311A) of the mounting casing (31A) is a double-barreled shaped, and a double-barreled caulking tube (B) can be set in the mounting casing (31A) of the caulking barrel (30A).

The electric caulking gun as described has the following advantages.

1. A person only press the switch (63) of the actuating assembly (60), then the motor (70), the actuating assembly (60) and the driving assembly (50, 50A) can make the pushing device (40, 40A) pushing the gel ejecting out the caulking tube (A, B) by the connecting post (42, 42A), and this is labor-saving and convenient in use.

2. Furthermore, the rack (41, 41A) and the pushing shafts (43, 43A) can be moved backward by the idle running of the rotating ring (224) and this can prevent the gel from flowing out the caulking tube (A, B) when not using the electric caulking gun.

What is claimed is:

1. An electric caulking gun having a body having a mounting section having a front end;

a rear end;

an interior;

a front opening being formed in the front end of the mounting section and communicates with the interior; and a rear opening being formed in the rear end the mounting section and communicates with the interior; and a handle section being extended transversely from the mounting section and having a top end being formed on the mounting section near the front end;

a lower end;

a chamber being formed in the handle section between the top end and the lower end and communicates with the interior of the mounting section;

an outer surface; and a connecting hole being formed through the outer surface of the handle section;

a gearbox being mounted in the body and having a seat having a front end;

a rear end;

a connecting panel being formed on the front end of the seat, being connected securely to the mounting section in the front opening and having a center;

a rear side;

a rack hole being formed through the center of the connecting panel and having two sides; and two pushing shaft holes being formed through the connecting panel and being respectively near the sides of the rack hole; and a side panel being formed on the rear side of the connecting panel and having a front end;

a rear end;

an inner surface;

an outer surface;

a first axle hole being formed through the side panel near the front end below the rack hole;

a mounting recess being formed in the inner surface of the side panel near the rear end and having a center;

a second axle hole being formed through the center of the mounting recess; and a pushing element recess being formed in the inner surface of the side panel between first axle hole and the mounting recess and communicates with the mounting recess; and a fixed block being formed on the rear end of the side panel and aligning with the rear opening of the mounting section and having a rack hole being formed through the fixed block, aligning with the rack hole of the connecting panel and having two sides; and two pushing shaft holes being formed through the fixed block and being respectively near the sides of the rack hole of the fixed block and respectively aligning with the pushing shaft holes of the connecting panel;

a mounting sheath being connected to the seat in the mounting section and having a jacket being connected to the side panel and having an open end being mounted securely around the mounting recess in the side panel;

a closed end;

an external surface;

an internal surface; and multiple engaging teeth being formed around the internal surface of the jacket near the closed end;

a covering section being formed on the external surface of the jacket, being faced to the pushing element recess and having an outer surface; and an elongated hole being formed through the outer surface of the covering section and aligning with the pushing element recess; and a rotating ring being mounted rotatably in the mounting recess of the side panel and having an external surface;

an internal surface;

multiple mounting slots being formed equi-spaced in the external surface of the rotating ring and correspond to the pushing element recess in the side panel; and multiple engaging teeth being formed on the internal surface of the rotating ring and aligning with the engaging teeth of the jacket;

a caulking barrel being connected to the gearbox;

a pushing device being connected movably to the gearbox and having a rack being connected movably to the seat and extends through the rack holes and having a front end being extended to the front opening of the mounting section;

a rear end being extended out the rear opening of the mounting section; and a bottom face, two pushing shafts being respectively connected movably to the seat, extend through the pushing holes and each pushing shaft having a front end being extended out the front opening; and a rear end extending out the rear opening;

a linking sheet being mounted securely on the rear ends of the rack and the pushing shafts; and a pushing disc being connected to the front ends of the pushing shafts and aligning with the caulking barrel;

a driving assembly being mounted in the gearbox and having a planet gear mechanism being mounted in the mounting sheath and having multiple planet gear assemblies, one of the planet gear assemblies being mounted in the rotating ring and engaging with the engaging teeth;

a driving axle being mounted rotatably in the second axle hole and being extended in the rotating ring between the planet gear assembly and having an inner end being extended in the rotating ring; and an outer end being extended out the outer surface of the side panel through the second axle hole;

a driving gear wheel being mounted around the outer end of the driving axle;

a driven axle being mounted in the side panel and the gear container and having an inner end; and an outer end being extended out the side panel through the first axle hole;

a driven gear wheel being mounted around the outer end of the driven axle and engaging with the driving gear wheel; and an actuating gear wheel being mounted around the driven axle near the inner end and engaging with the rack;

an actuating assembly being connected to the gearbox and the body and having a pushing element being mounted between the pushing element recess and the elongated hole and having an inserting block being mounted movably in the pushing element recess and having a front side; and a pushing section being formed on the front side of the inserting block, being extended in the elongated hole of the covering section and having an inner face;

an outer face;

an inclined plane being defined on the inner face of the pushing section; and a mounting hole being formed in the outer face of the pushing section;

a first spring being mounted in the mounting hole of the pushing element and abutting against a sidewall of the pushing element recess;

a switch being connected to the handle section of the body and abutting against the pushing element and having a pressing arm being connected pivotally to the handle section and having an upper end being connected pivotally to the handle section;

a lower end being extended out the handle section through the connecting hole; and a rear side;

a connecting arm being formed on the rear side of the pressing arm near the upper end and extending to the pushing element; and a connecting pin being mounted securely to the connecting arm opposite to the pressing arm and abutting against the incline plane of the pushing element; and a second spring being mounted between the handle section and the rear side of the pressing arm;

a motor being mounted in the body between the mounting section and the mounting sheath of the gearbox; and a power source being detachably connected to the handle section of the body.

2. The electric caulking gun as claimed in claim 1, wherein the handle section further has a mounting hole being formed through the outer surface of the handle section below the connecting hole;

an inserting hole being defined on the lower end of the handle section and communicates with the chamber; and a circuit contact being attached to the handle section near the inserting hole;

the mounting sheath further has a through hole that being formed through the closed end of the jacket;

the actuating assembly further has a transmission being connected electrically to the circuit contact in the mounting hole of the handle section and having a top;

a bottom;

an adjustable resistance being formed on the top of the transmission; and a rotating button being formed on the bottom of the transmission and protruding out the handle section through the mounting hole; and a fine-tuning switch being mounted in the handle section between the connecting arm and the second spring and being connected electrically to the adjustable resistance of the transmission;

the motor being electrically connected to the fine-tuning switch and having an inner side;

a rotating shaft being connected rotatably to inner side of the motor and extending in the jacket through the through hole; and a gear wheel being mounted around the rotating shaft and engaging with one of the planet gear assemblies; and the power source further has a joint being formed on the top of the power source and being connected electrically to the circuit contact.

3. The electric caulking gun as claimed in claim 2, wherein the side panel further has an axle bearing mounted in the first axle hole;

the jacket further has an engaging recess being formed on the internal surface of the jacket near the open end;

the mounting sheath further has a gear container being formed on external surface of the jacket adjacent to the covering section, being mounted around the first axle hole in the side panel and having a axle hole being formed through the gear container and aligns with the first axle hole in the side panel; and an axle bearing being mounted in the axle hole of the gear container; and a gear ring being mounted in the engaging recess of the jacket and having an internal surface; and multiple engaging teeth being formed around the internal surface of the gear ring and aligned with the engaging teeth of the jacket;

the rack further has multiple pushing teeth being formed on the bottom face of the rack and engaging with the actuating gear wheel; and a pushing post being formed on the front end of the rack; and the driven axle being mounted in the side panel and the gear container between the axle bearings and the inner end of the driven axle extending in the axle hole of the gear container.

4. The electric caulking gun as claimed in claim 3, wherein the caulking barrel further has a mounting casing being semicircular, being connected to the connecting panel in the front opening of the mounting section and having a front end;

a rear end and being mounted around the connecting panel of the seat; and a mounting recess being formed between the front end and the rear end of the mounting casing; and a limiting panel being attached to the front end of the mounting casing and having a U-shaped through hole that communicates with the mounting recess of the mounting casing.

5. The electric caulking gun as claimed in claim 4, wherein the planet gear mechanism has four planet gear assemblies, and three of the planet gear assemblies are mounted in the jacket and the gear ring and engage with the engaging teeth.

6. An electric caulking gun having a body having a mounting section having a front end;

a rear end;

an interior;

a front opening being formed in the front end of the mounting section and communicates with the interior; and a rear opening being formed in the rear end of the mounting section and communicates with the interior; and a handle section being extended transversely from the mounting section and having a top end being formed on the mounting section near the front end;

an lower end;

a chamber being formed in the handle section between the top end and the lower end and communicates with the interior of the mounting section;

an outer surface; and a connecting hole being formed through the outer surface of the handle section;

a gearbox being mounted in the body and having a seat having a front end;

a rear end;

a connecting panel being formed on the front end of the seat, being connected securely to the mounting section in the front opening and having a rear side;

two rack holes being formed through the connecting panel; and a side panel being formed on the rear side of the connecting panel and having a front end;

a rear end;

an inner surface;

an outer surface;

a first axle hole being formed through the side panel near the front end below the rack hole;

a mounting recess being formed in the inner surface of the side panel near the rear end and having a center;

a second axle hole being formed through the center of the mounting recess; and a pushing element recess being formed in the inner surface of the side panel between first axle hole and the mounting recess and communicates with the mounting recess; and a fixed block being formed on the rear end of the side panel, aligning with the rear opening of the mounting section and having two rack holes being formed through the fixed block and aligning with the rack holes of the connecting panel; and a mounting sheath being connected to the seat in the mounting section and having a jacket being connected to the side panel and having an open end being mounted securely around the mounting recess in the side panel;

a closed end;

an external surface;

an internal surface; and multiple engaging teeth being formed around the internal surface of the jacket near the closed end;

a covering section being formed on the external surface of the jacket, being faced to the pushing element recess and having an outer surface; and an elongated hole being formed through the outer surface of the covering section and aligning with the pushing element recess; and a rotating ring being mounted rotatably in the mounting recess of the side panel and having an external surface;

an internal surface;

multiple mounting slots being formed equi-spaced in the external surface of the rotating ring and correspond to the pushing element recess in the side panel; and multiple engaging teeth being formed on the internal surface of the rotating ring and aligning with the engaging teeth of the jacket;

a caulking barrel being connected to the gearbox;

a pushing device being connected movably to the gearbox and having two racks being connected movably to the seat and extends through the rack holes and each rack having a front end being extended to the front opening of the mounting section;

a rear end being extended out the rear opening of the mounting section; and a bottom face, a linking sheet being mounted securely on the rear ends of the racks; and a pushing disc being connected to the front ends of the pushing shafts and aligning with the caulking barrel;

a driving assembly being mounted in the gearbox and having a planet gear mechanism being mounted in the mounting sheath and having multiple planet gear assemblies, one of the planet gear assemblies being mounted in the rotating ring and engaging with the engaging teeth;

a driving axle being mounted rotatably in the second axle hole and being extended in the rotating ring between the planet gear assembly and having an inner end being extended in the rotating ring; and an outer end being extended out the outer surface of the side panel through the second axle hole;

a driving gear wheel being mounted around the outer end of the driving axle;

a driven axle being mounted in the side panel and the gear container and having an inner end; and an outer end being extended out the side panel through the first axle hole;

a driven gear wheel being mounted around the outer end of the driven axle and engaging with the driving gear wheel; and two actuating gear wheels being mounted around the driven axle and engaging with the racks;

an actuating assembly being connected to the gearbox and the body and having a pushing element being mounted between the pushing element recess and the elongated hole and having an inserting block being mounted movably in the pushing element recess and having a front side; and a pushing section being formed on the front side of the inserting block, being extended in the elongated hole of the covering section and having an inner face;

an outer face;

an inclined plane being defined on the inner face of the pushing section; and a mounting hole being formed in the outer face of the pushing section;

a first spring being mounted in the mounting hole of the pushing element and abutting against a sidewall of the pushing element recess;

a switch being connected to the handle section of the body and abutting against the pushing element and having a pressing arm being connected pivotally to the handle section and having an upper end being connected pivotally to the handle section;

a lower end being extended out the handle section through the connecting hole; and a rear side;

a connecting arm being formed on the rear side of the pressing arm near the upper end and extending to the pushing element; and a connecting pin being mounted securely to the connecting arm opposite to the pressing arm and abutting against the incline plane of the pushing element; and a second spring being mounted between the handle section and the rear side of the pressing arm;

a motor being mounted in the body between the mounting section and the mounting sheath of the gearbox; and a power source being connected detachable to the handle section of the body.

7. The electric caulking gun as claimed in claim 6, wherein the handle section further has a mounting hole being formed through the outer surface of the handle section below the connecting hole;

an inserting hole being defined on the lower end of the handle section and communicates with the chamber; and a circuit contact being attached to the handle section near the inserting hole;

the mounting sheath further has a through hole that being formed through the closed end of the jacket;

the actuating assembly further has a transmission being connected electrically to the circuit contact in the mounting hole of the handle section and having a top;

a bottom;

an adjustable resistance being formed on the top of the transmission; and a rotating button being formed on the bottom of the transmission and protruding out the handle section through the mounting hole; and a fine-tuning switch being mounted in the handle section between the connecting arm and the second spring and being connected electrically to the adjustable resistance of the transmission;

the motor being electrically connected to the fine-tuning switch and having an inner side;

a rotating shaft being connected rotatably to the inner side of the motor and extending in the jacket through the through hole; and a gear wheel being mounted around the rotating shaft and engaging with one of the planet gear assemblies; and the power source further has a joint being formed on the top of the power source and being connected electrically to the circuit contact.

8. The electric caulking gun as claimed in claim 7, wherein the side panel further has an axle bearing mounted in the first axle hole;

the jacket further has an engaging recess being formed on the internal surface of the jacket near the open end;

the mounting sheath further has a gear container being formed on external surface of the jacket adjacent to the covering section, being mounted around the first axle hole in the side panel and having a axle hole being formed through the gear container and aligns with the first axle hole in the side panel; and a axle bearing being mounted in the axle hole of the gear container; and a gear ring being mounted in the engaging recess of the jacket and having an internal surface; and multiple engaging teeth being formed around the internal surface of the gear ring and aligned with the engaging teeth of the jacket;

each rack further has multiple pushing teeth being formed on the bottom face of the rack and engaging with the corresponding actuating gear wheel; and a pushing post being formed on the front end of the rack; and the driven axle being mounted in the side panel and the gear container between the axle bearings and the inner end of the driven axle extending the axle hole of the gear container.

9. The electric caulking gun as claimed in claim 8, wherein the caulking barrel further has a mounting casing being double-barreled shaped, being connected to the connecting panel in the front opening of the mounting section and having a front end;

a rear end and being mounted around the connecting panel of the seat; and a mounting recess being formed between the front end and the rear end of the mounting casing; and a limiting panel being attached to the front end of the mounting casing and having a U-shaped through hole that communicates with the mounting recess of the mounting casing.

10. The electric caulking gun as claimed in claim 9, wherein the planet gear mechanism has four planet gear assemblies, and three of the planet gear assemblies are mounted in the jacket and the gear ring and engage with the engaging teeth.

* * * * *